US006644438B1

(12) United States Patent
Chang et al.

(10) Patent No.: US 6,644,438 B1
(45) Date of Patent: Nov. 11, 2003

(54) POLE CLIMBING AND SAFETY DEVICE

(75) Inventors: Ezra T. Chang, Scarborough (CA); Ronald A Smith, Queensville (CA)

(73) Assignee: Scepter Corporation, Scarborough (CA)

( * ) Notice: Subject to any disclaimer, the term of this patent is extended or adjusted under 35 U.S.C. 154(b) by 0 days.

(21) Appl. No.: 10/235,570

(22) Filed: Sep. 6, 2002

(51) Int. Cl.[7] ..... A47L 3/04
(52) U.S. Cl. ..... 182/9; 182/187
(58) Field of Search ..... 182/3, 5, 7, 9, 182/133, 134, 135, 136, 187, 206, 221

(56) References Cited

U.S. PATENT DOCUMENTS

| | | | | | |
|---|---|---|---|---|---|
| 213,715 | A | * | 3/1879 | Mengden | 182/9 |
| 1,120,496 | A | * | 12/1914 | Holsclaw | 182/9 |
| 2,920,714 | A | * | 1/1960 | Johnson | 182/9 |
| 4,527,660 | A | * | 7/1985 | Andruchiw | 182/9 |
| 4,747,468 | A | * | 5/1988 | Greenway | 182/9 |
| 5,141,074 | A | * | 8/1992 | Sulowski et al. | 182/9 |
| 5,165,499 | A | * | 11/1992 | Bell | 182/9 |
| 5,184,696 | A | * | 2/1993 | Meed et al. | 182/9 |
| 5,222,991 | A | * | 6/1993 | Bell | 182/9 |
| 5,779,001 | A | * | 7/1998 | Skyba | 182/107 |

FOREIGN PATENT DOCUMENTS

| | | | | |
|---|---|---|---|---|
| JP | 33726 | * | 2/1996 | 182/9 |

* cited by examiner

*Primary Examiner*—Bruce A. Lev
(74) *Attorney, Agent, or Firm*—Robert F. Delbridge

(57) ABSTRACT

A pole climbing and safety device has a flexible strap which in use is passed around the pole on the opposite side thereof to a climber, and a pair of handles each adjacent a respective opposite end of the strap and grippable by the climber's hands, each handle being pivotally connected to the respective opposite end of the strap for pivotal movement relative thereto about an upright axis. The device also has a pair of harness attachment arms each adjacent an opposite end of the strap and to which left and right harness members of a harness worn by the climber are respectively attached when in use, each harness attachment arm being pivotally connected to the adjacent end of the strap for pivotal movement relative to the strap and to the adjacent handle about the same upright pivotal axis. Each harness attachment arm is located laterally inwardly of the adjacent handle when the device is in use on a pole, and carries a pole engaging member between the upright axis and the respective harness attachment which engages the pole when in use to prevent the device from sliding down the pole.

4 Claims, 7 Drawing Sheets

POLE CLIMBING AND SAFETY DEVICE

FIELD OF INVENTION

This invention relates to pole climbing and safety devices for climbing poles such as utility poles or trees.

BACKGROUND OF INVENTION

Pole climbing and safety devices which assist climbers to climb poles have been known for many years, see for example U.S. Pat. No. 4,747,468 (Greenway) issued May 31, 1988, the contents of which are hereby incorporated herein by reference. Such devices usually include handles gripped by the climber, attachment points to which a harness worn by the climber is attachable and pole engaging members which engage the pole to prevent the device from sliding down the pole.

It is an object of the present invention to provide a relatively simple and inexpensive pole climbing and safety device which has the features mentioned above.

SUMMARY OF INVENTION

According to the invention, a pole climbing and safety device has a flexible strap which in use is passed around the pole on the opposite side thereof to a climber, and a pair of handles each adjacent a respective opposite end of the strap and grippable by the climber's hands. Each handle is pivotally connected to the respective opposite end of the strap for pivotal movement relative thereto about an upright axis. A pair of harness attachment arms each adjacent an opposite end of the strap are provided to which left and right harness members of the harness worn by the climber are respectively attached when in use. Each harness attachment arm is pivotally connected to the respective adjacent end of the strap for pivotal movement relative to the strap and to the adjacent handle about the same upright pivotal axis. Each harness attachment arm is located laterally inwardly of the adjacent handle when the device is in use on a pole. Each harness attachment arm attachment arm carries a pole engaging member between said upright axis and the respective harness attachment which engages the pole when in use to prevent the device from sliding down the pole.

The handle may have a laterally inwardly open recess which receives the pole engaging member.

The handle and harness attachment arm at each end of the strap may be secured thereto by a pin to which the handle and harness attachment arm are attached and which extends through a loop in the adjacent end of the strap, the pin providing the upright pivotal axis.

DESCRIPTION OF DRAWINGS

One embodiment of the invention will now be described, by way of example only, with reference to the accompanying drawings, of which.

DESCRIPTION OF PREFERRED EMBODIMENT

Figure 1:
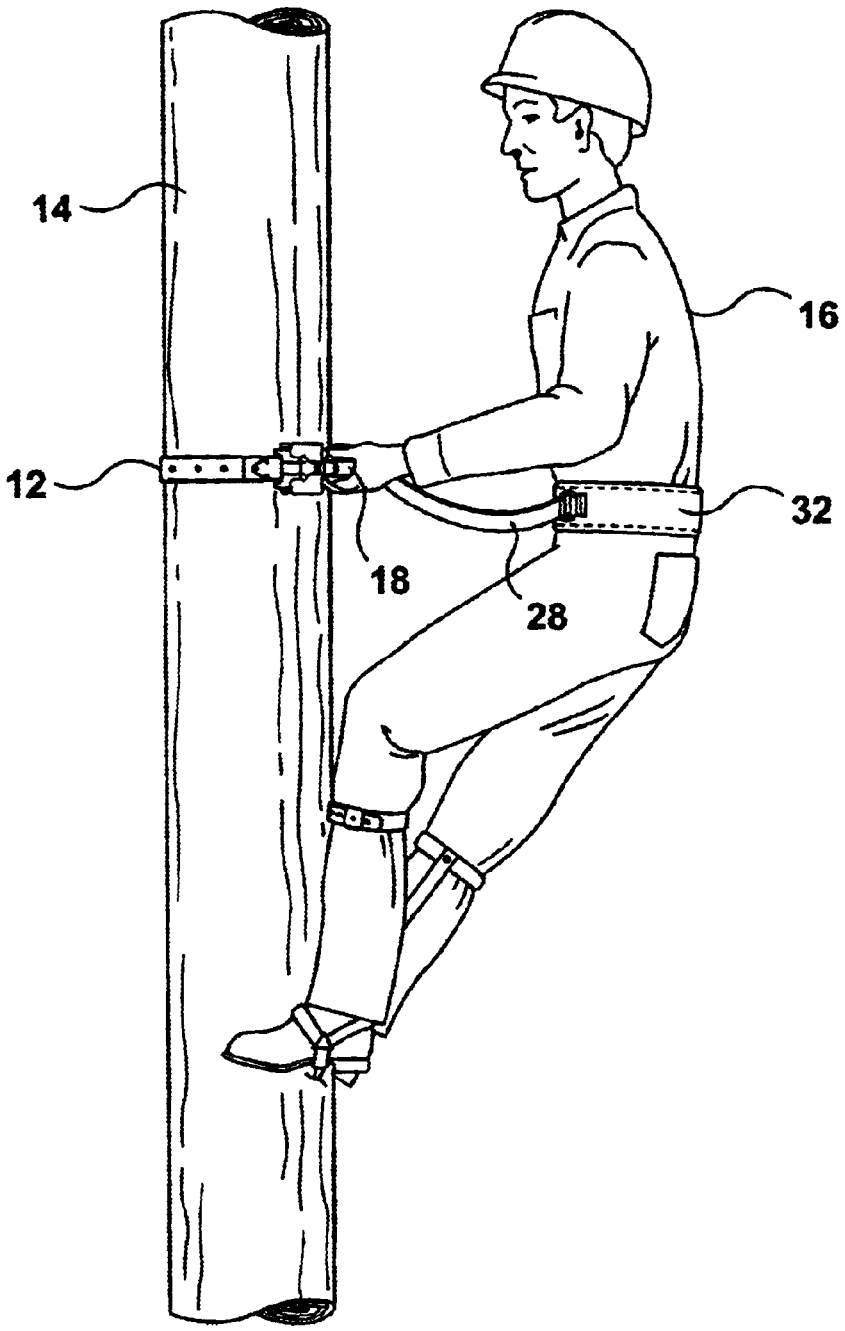
FIG. 1 is a side view of a climber climbing a pole with a pole climbing and safety device in accordance with one embodiment of the invention.
Figure 2:
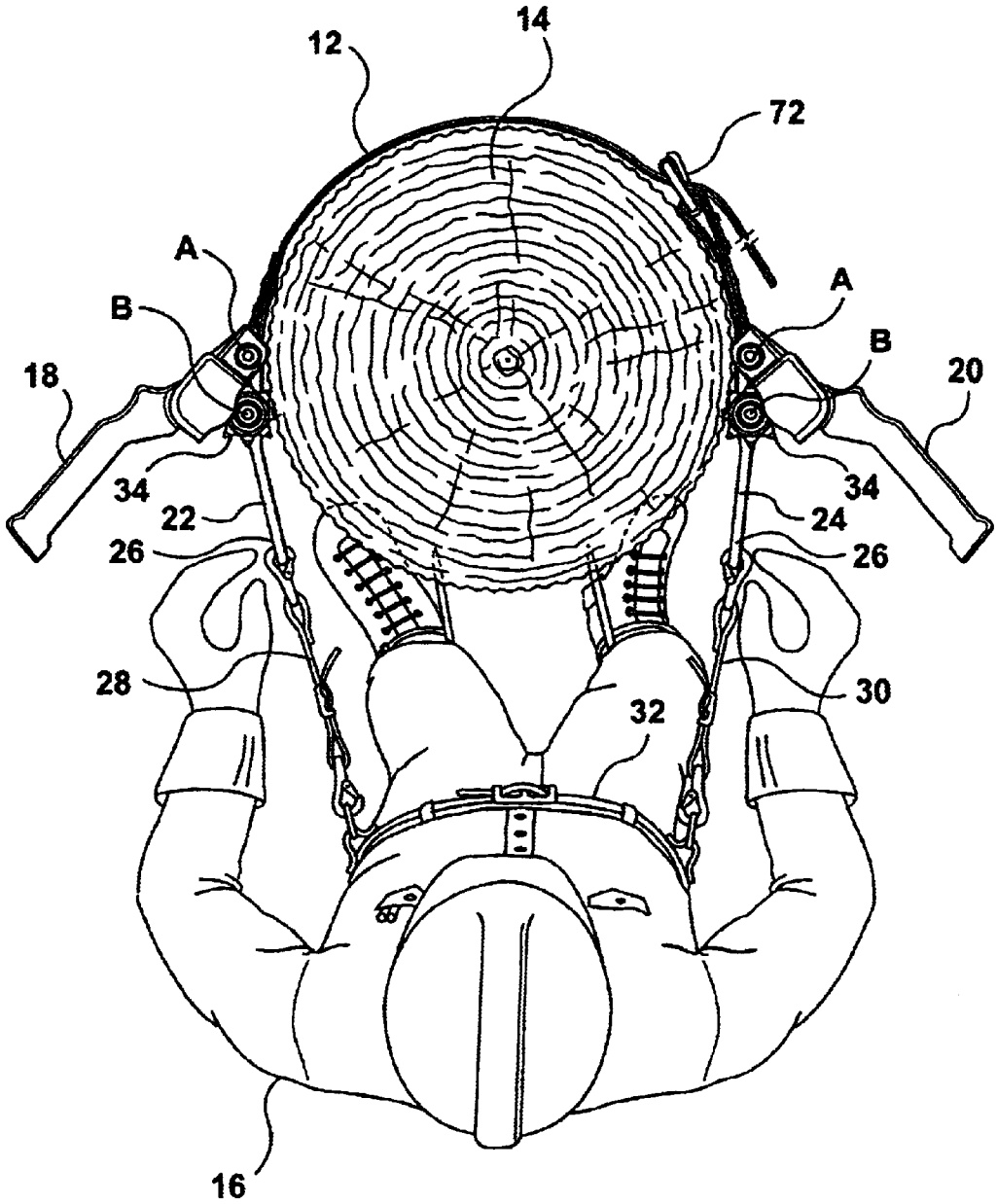
FIG. 2 is a plan view of the climber, showing (in section) the pole and pole climbing and safety device shown in FIG. 1.
Figure 3:
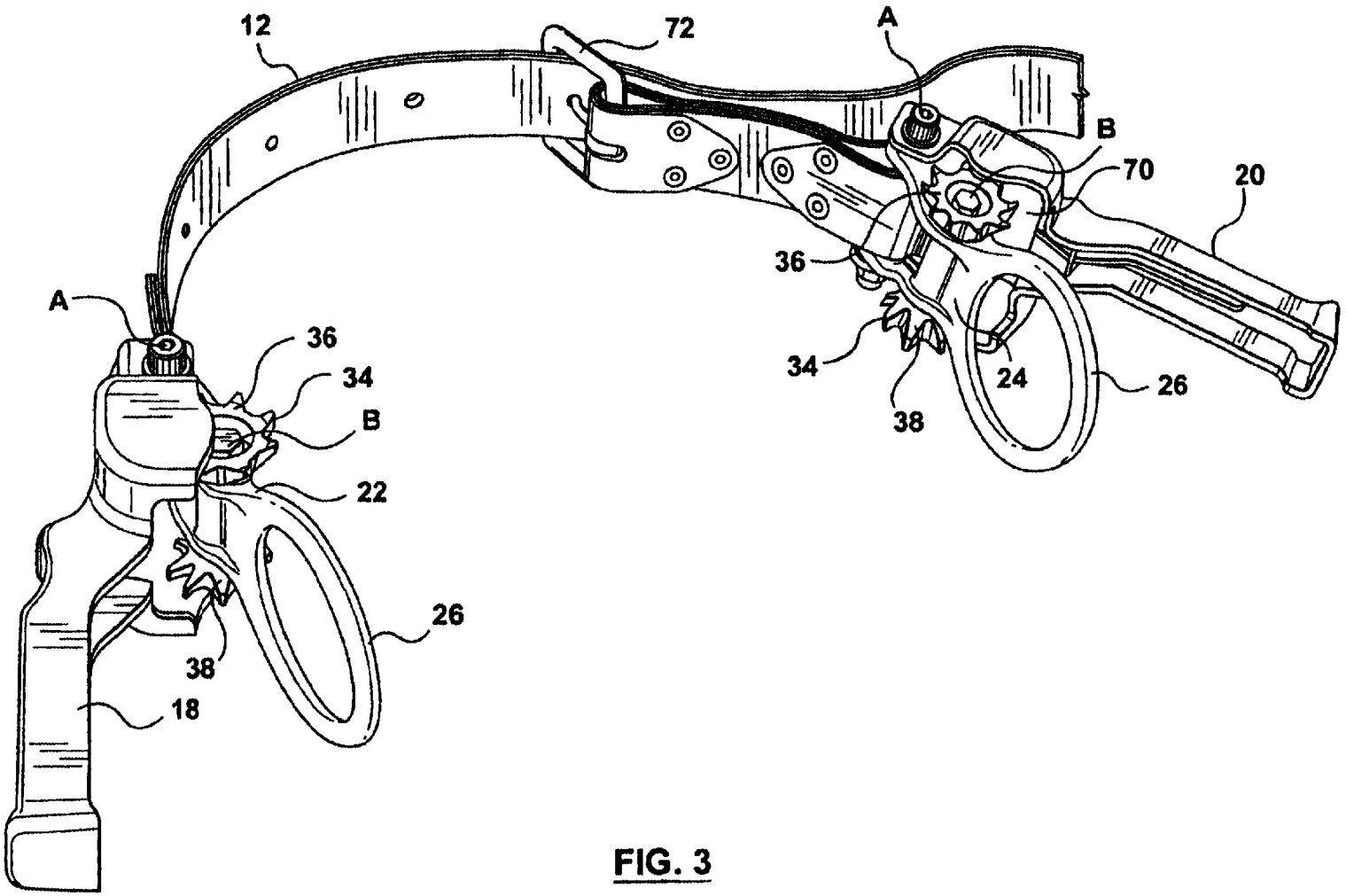
FIG. 3 is a perspective view of the pole climbing and safety device.
Figure 4:
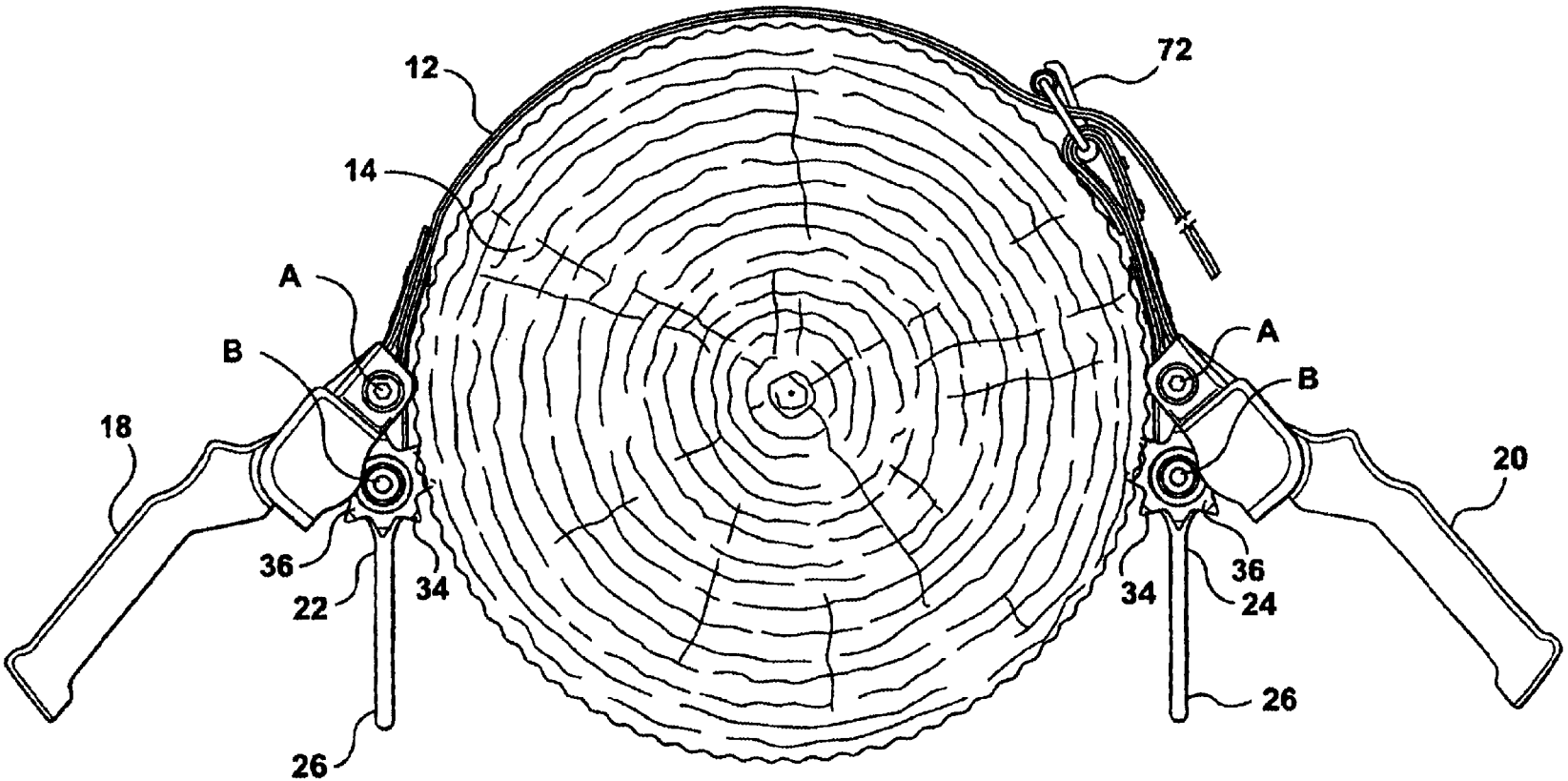
FIG. 4 is a plan view of the pole climbing and safety device around the pole (seen in section)
Figure 5:
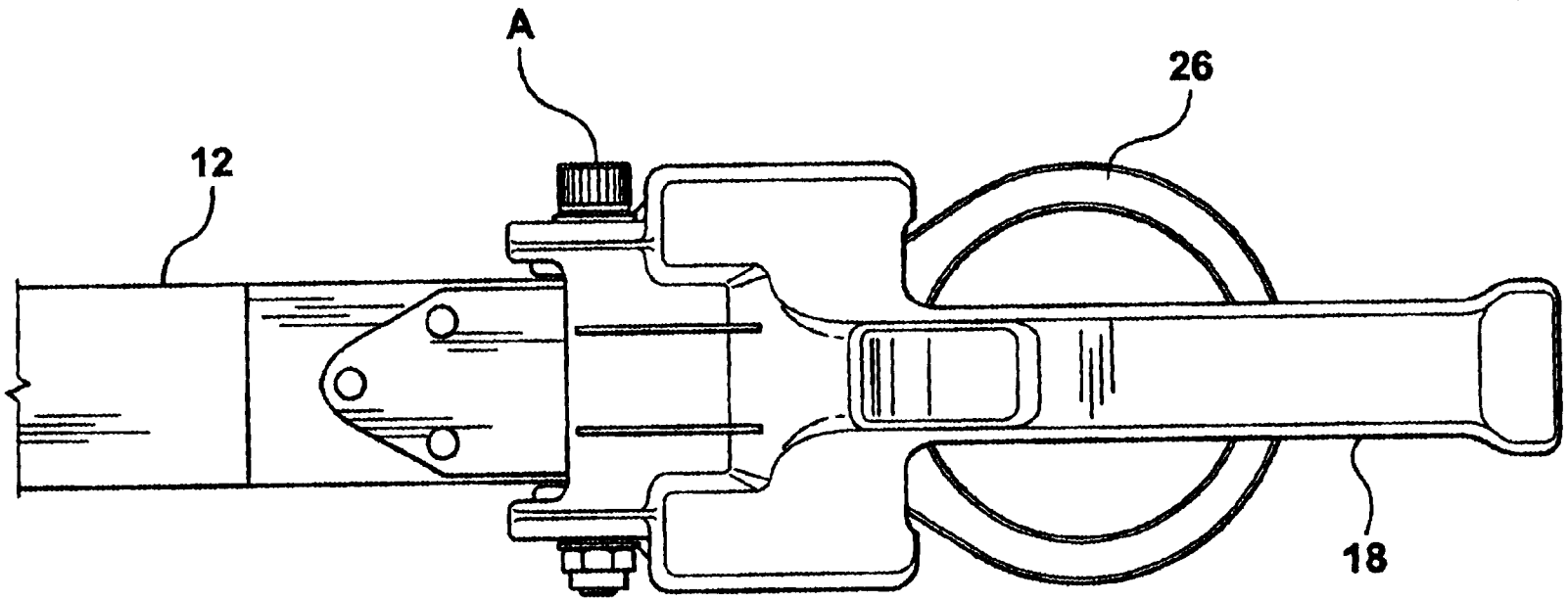
FIG. 5 is a front view of one end of the pole climbing and safety device.
Figure 6:
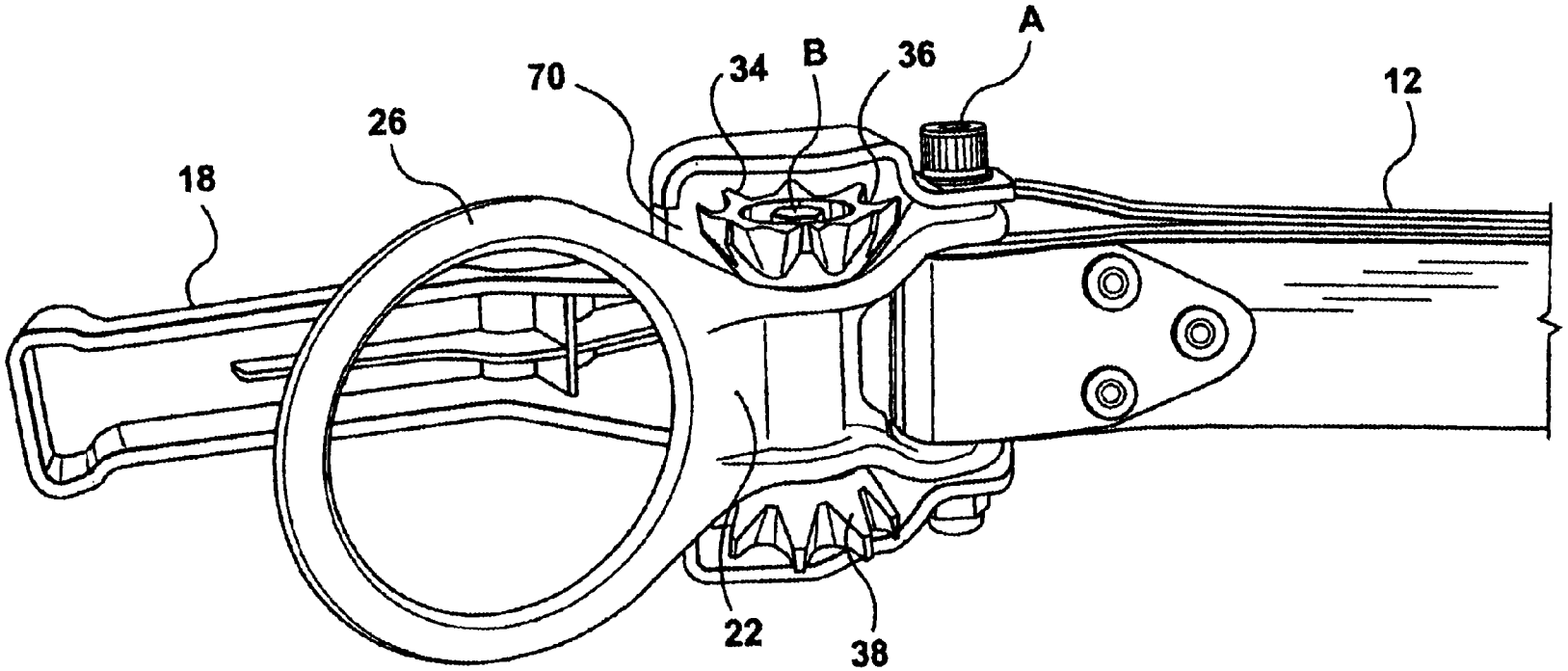
FIG. 6 is a rear view thereof.

Referring to the accompanying drawings, a pole climbing and safety device has a flexible strap 12 which in use is passed around a pole 14 on the opposite side thereof to a climber 16. The pole climbing and safety device also has a pair of handles 18, 20 each adjacent a respective end of the strap 12 and grippable by the climber's hands. Each handle 18, 20 is pivotally connected to the respective opposite end of the strap 12 for pivotal movement relative thereto about an upright axis A.

A pair of harness attachment arms 22, 24 are each adjacent an opposite end of the strap 12 and are pivotally connected to the respective adjacent end of the strap 12 for pivotal movement relative to the strap 12 and to the adjacent handle 18, 20 about the same upright axis A. Each harness attachment arm 22, 24 is located laterally inwardly of the adjacent handle 18, 20 and has a harness attachment ring 26 to which left and right harness members 28, 30 of a harness 32 worn by the climber 16 are attached when in use.

Each harness attachment arm 22, 24 carries a pole engaging member 34 between the upright access A and the respective harness attachment ring 26. Each pole engaging member 34 comprises two toothed gripper wheels 36, 38 rotatably mounted on the respective harness attachment arm 22, 24 for rotation about an upright axis B parallel to the axis A.

Figure 7:
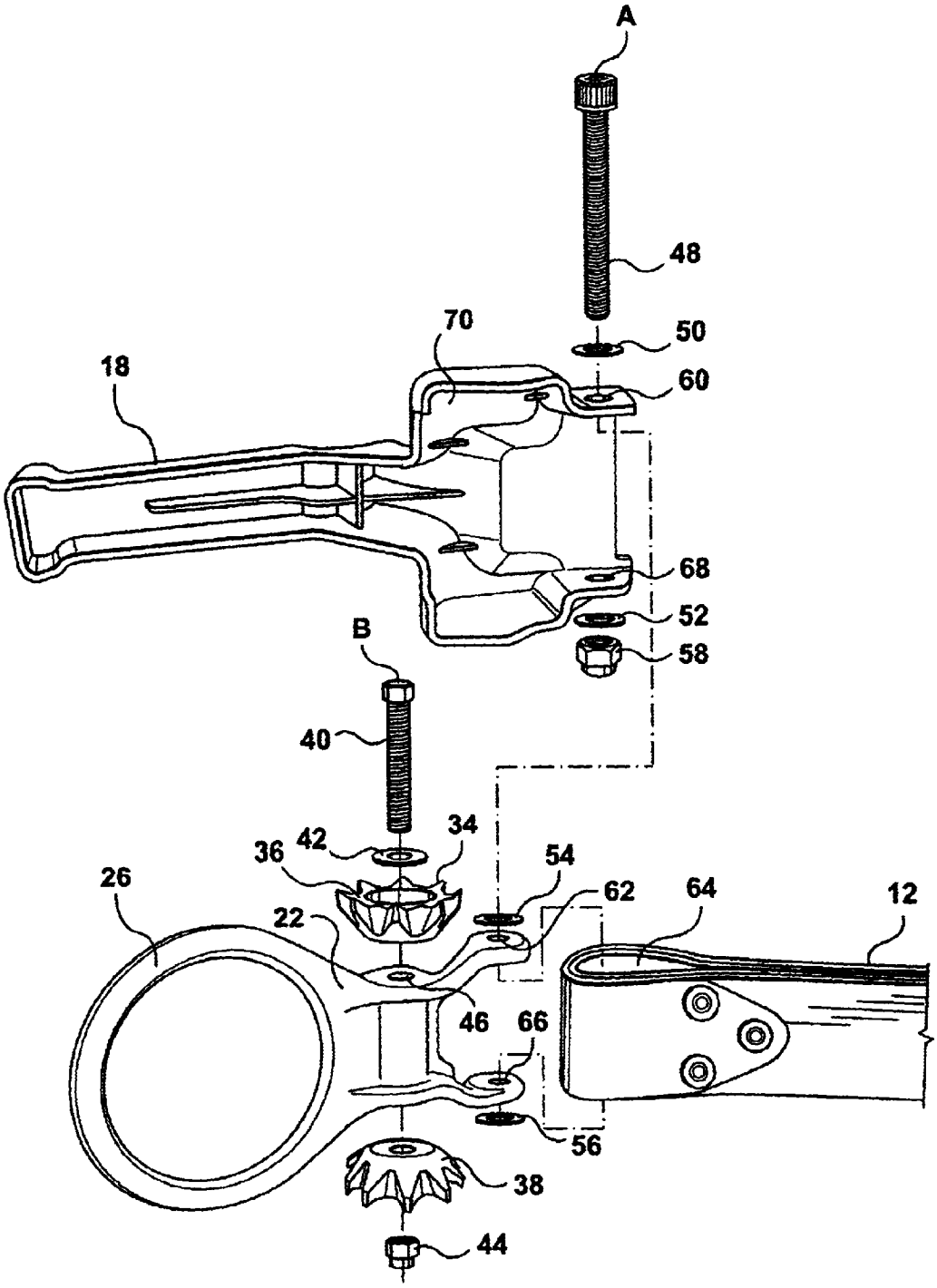
FIG. 7 is an exploded view of the end of the pole climbing and safety device shown in FIG. 6.

As shown in FIG. 7, toothed wheels 36,38 are located above and below respectively the harness attachment arm 22, 24 and are rotatably secured thereto by a bolt 40, washer 42 and nut 44. The bolt 40 (which defines axis B) passes through the upper toothed wheel 36, a bore 46 in the arm 22, 24 and the lower toothed wheel 38, a nut 44 being secured to the projecting end of the bolt 40 below the toothed wheel 38.

FIG. 7 also shows the manner in which each handle 18, 20 and each harness attachment arm 22, 24 are pivotally connected to the strap 12. Each pivotal connection is effected by a bolt 28 (which functions as a pin defining axis A), washer 50, washer 52, washers 54, 56 and nut 58. Each handle 18, 20 is of plastic material and is open in its laterally inner side. The bolt 48 passes through washer 50, upper aperture 60 in the handle 18, 20, washer 56, upper aperture 62 in attachment arm 22, 24, a loop 64 in the strap 12, a lower aperture 66 in attachment arm 22, 24, washer 56, lower aperture 68 in handle 18, 20 and washer 52. The nut 58 is secured via the projecting end of the bolt 48 below the washer 52.

Each pole engaging member 34 is conveniently received in a recess 70 in the handle 18, 20 when the handle is adjacent thereto. It should also be noted that the length of the strap 12 can be conveniently adjusted by a conventional buckle 52.

The manner in which the device operates will be clear to a person skilled in the art from the foregoing description of a preferred embodiment. The handles 18, 20 assist in handling, placing and manoeuvring the device, and the rotating gripper wheels 36, 38 allow the climber to effectively align the load with the stopping resistance. The handle, harness attachment arm and pole engaging member arrangement in accordance with the present invention provide a particularly advantageous arrangement. Other embodiments of the invention will also now be readily apparent to a person skilled in the art, the scope of the invention being defined by the appended claims.

What is claimed is:

1. A pole climbing and safety device having:

(a) a flexible strap which in use is passed around the pole on the opposite side thereof to a climber, (b) a pair of handles each adjacent a respective opposite end of the strap and grippable by the climber's hands, (c) each handle being pivotally connected to the respective opposite end of the strap for pivotal movement relative thereto about an upright axis, (d) a pair of harness attachment arms each adjacent an opposite end of the strap and to which left and right harness members of a harness worn by the climber are respectively attached when in use, (e) each harness attachment arm being pivotally connected to the adjacent end of the strap for pivotal movement relative to the strap and to the adjacent handle about the same upright pivotal axis, (f) each harness attachment arm being located laterally inwardly of the adjacent handle when the device is in use on a pole, (g) each harness attachment arm carrying a pole engaging member between said upright axis and the respective harness attachment which engages the pole when in use to prevent the device from sliding down the pole.

2. A pole climbing and safety device according to claim 1 wherein each handle has a laterally inwardly open recess which receives the pole engaging member.

3. A pole climbing and safety device according to claim 1 wherein the handle and harness attachment arm at each end of the strap are secured thereto by a pin to which the handle and harness attachment arm are attached and which extends through a loop in the adjacent end of the strap, said pin providing said upright pivotal axis.

4. A pole climbing and safety device according to claim 1 wherein each pole engaging member comprises a toothed wheel rotatably mounted on the respective harness attachment arm for rotation about a second upright axis parallel to the first mentioned upright axis.

* * * * *